US008991616B2

(12) United States Patent
Parr et al.

(10) Patent No.: US 8,991,616 B2
(45) Date of Patent: Mar. 31, 2015

(54) MATERIAL SORTING DISCS WITH VARIABLE INTERFACIAL OPENING

(71) Applicant: Bulk Handling Systems, Eugene, OR (US)

(72) Inventors: Chris Parr, Eugene, OR (US); Maxim Hoffman, Eugene, OR (US); Dane Campbell, Eugene, OR (US)

(73) Assignee: Emerging Acquisitions, LLC, Eugene, OR (US)

( * ) Notice: Subject to any disclaimer, the term of this patent is extended or adjusted under 35 U.S.C. 154(b) by 0 days.

(21) Appl. No.: 13/683,982

(22) Filed: Nov. 21, 2012

(65) Prior Publication Data

US 2014/0138289 A1 May 22, 2014

(51) Int. Cl.

| | |
|---|---|
| ***B07B 13/00*** | (2006.01) |
| ***B07B 1/06*** | (2006.01) |
| ***B07B 1/15*** | (2006.01) |

(52) U.S. Cl.
CPC .... *B07B 1/06* (2013.01); *B07B 1/15* (2013.01)
USPC ..... 209/672; 209/667

(58) Field of Classification Search
CPC ..... B07B 1/15
USPC ..... 209/672, 667, 671, 673, 392
See application file for complete search history.

(56) References Cited

U.S. PATENT DOCUMENTS

| | | | | |
|---|---|---|---|---|
| 2,082,302 | A | 6/1937 | Ross | |
| 5,450,966 | A | 9/1995 | Clark et al. | |
| 5,799,801 | A | 9/1998 | Clark et al. | |
| 6,371,305 | B1 | 4/2002 | Austin et al. | |
| 6,986,425 | B2 * | 1/2006 | Paladin | 209/671 |
| 8,424,684 | B2 * | 4/2013 | Campbell et al. | 209/671 |

FOREIGN PATENT DOCUMENTS

| | | | |
|---|---|---|---|
| DE | 20116220 | U1 | 2/2002 |
| GB | 2186503 | A | 8/1987 |
| GB | 2432097 | A | 5/2007 |
| WO | 02062493 | A1 | 8/2002 |

OTHER PUBLICATIONS

European Patent Office, "International Search Report and Written Opinion" for PCT/US2013/070804, Feb. 17, 2014, 12 pages.

* cited by examiner

*Primary Examiner* — Luis A Gonzalez
(74) *Attorney, Agent, or Firm* — Stolowitz Ford Cowger LLP

(57) ABSTRACT

A disc screen includes a shaft, a first disc mounted on the shaft, and a second disc mounted on the shaft. An interfacial opening (IFO) extends between the first disc and the second disc. A width of the IFO as measured between the first disc and the second disc varies according to a rotational position of the shaft.

24 Claims, 10 Drawing Sheets

MATERIAL SORTING DISCS WITH VARIABLE INTERFACIAL OPENING

BACKGROUND OF THE INVENTION

1. Field of the Invention

Material sorting discs and material sorting screen.

2. Description of the Related Art

Discs, rolls, screens, and/or other types of material sorting systems may be used as part of a multi-stage materials separating system. For example, material sorting systems may be used in the materials handling industry for screening large flows of materials to remove certain items of desired dimensions, or in classifying desired materials from residual materials. The material sorting system may separate the materials fed into it by size. The size classification may be adjusted to meet virtually any specific application.

The material being separated and/or classified may consist of various constituents, such as soil, aggregate, asphalt, concrete, wood, biomass, ferrous and nonferrous metal, plastic, ceramic, paper, cardboard, or other products or materials recognized as material throughout consumer, commercial and industrial markets.

A major problem with disc and/or roll screens is jamming. Material that jams between the disc/roll and the adjacent shaft may, in some cases, physically cause the screen to stop working properly, or produce momentary stoppages. Such stoppages may not cause the drive mechanism of the material sorting system to turn off but they may cause substantial mechanical shock. This mechanical shock may eventually result in the premature failure of the material sorting system's assemblies and drive mechanism.

SUMMARY OF THE INVENTION

A disc for a material separation screen is herein disclosed, as comprising a first side, a second side located on an opposite side of the disc as the first side, and a contact surface adjoining both the first side and the second side. A width of the contact surface may vary along a perimeter of the disc.

A disc screen is herein disclosed, as comprising a shaft, a first disc mounted on the shaft, and a second disc mounted on the shaft. An interfacial opening (IFO) may extend between the first disc and the second disc. A width of the IFO, as measured between the first disc and the second disc, may vary according to a rotational position of the IFO about the shaft.

A length of the IFO may be made to vary according to a rotational position of the IFO about the shaft. The length of the IFO may be measured between one or more shafts, spacers, and/or discs. In some embodiments, both the width and length of the IFO may be made to vary at the same time. A distance as between two discs located on parallel spaced apart shafts may be made to vary as a function of angular rotation of one or both of the two discs and/or two shafts.

The foregoing and other objects, features and advantages of the invention will become more readily apparent from the following detailed description and accompanying drawings.

DETAILED DESCRIPTION OF THE INVENTION

Material separation systems, including disc screens, may have a screening bed with a series of rotating spaced parallel shafts. Each shaft may have a longitudinal series of concentric screen discs separated by spacers which interdigitate with the screen discs of the adjacent shafts. The relationship of the discs and/or spacers on one shaft to the discs and/or spacers on each adjacent shaft form an opening generally known in the industry as an interfacial opening or "IFO". The IFO may be configured such that only material of acceptable size is allowed to pass downwardly through the disc screen. The acceptable sized material which drops through the IFO is commonly referred to in the industry as "Unders".

The discs on the disc screen may all be driven to rotate in a common direction from an infeed end of the screening bed to an outfeed or discharge end of the screening bed. Thus, materials which are larger than the IFO, referred to in the industry as "Overs", may be advanced on the screening bed to the outfeed end, where they may be sorted and/or processed further.

Figure 1:
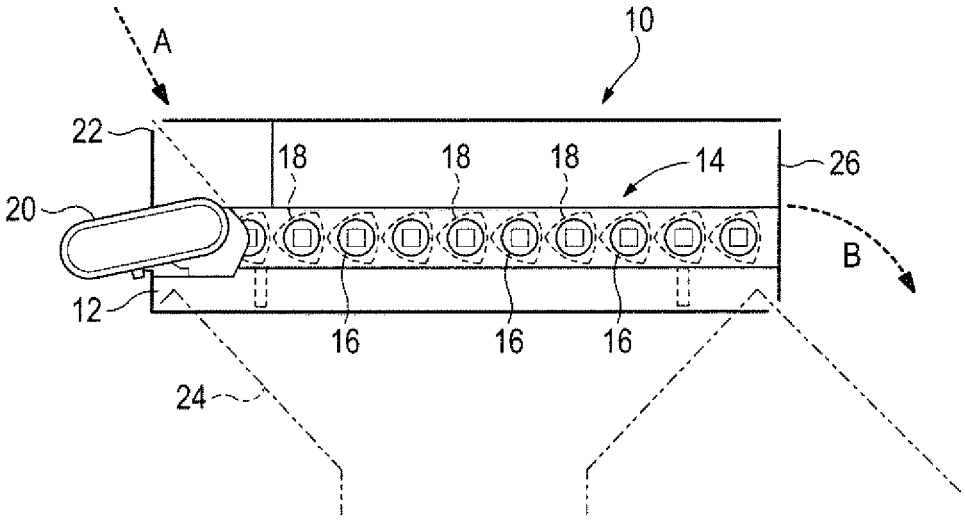
FIG. 1 illustrates a side elevational view of a material separation system.

FIG. 1 illustrates a side elevational view of a material separation system 10, including a frame 12 supporting a screening bed 14 and a series of co-rotating spaced parallel shafts 16 of similar or equal length. A plurality of shafts 16 each may include a longitudinal series of screen discs 18. The shafts 16 may be driven in unison, e.g., in the same direction of rotation, by suitable drive means 20 such as a motor, gearing, and/or belt drive, etc.

Material to be screened may be delivered to an infeed end 22 of screen bed 14 as indicated by directional arrow A. The constituents of sufficiently small and/or acceptable size (i.e., Unders) drop through the IFOs associated with discs 18 and are received in a hopper 24. Materials and/or constituents which are too large to pass through the IFOs (i.e., Overs) may be advanced and discharged, as indicated by directional arrow B, from end 26 of screening bed 14.

Figure 2:
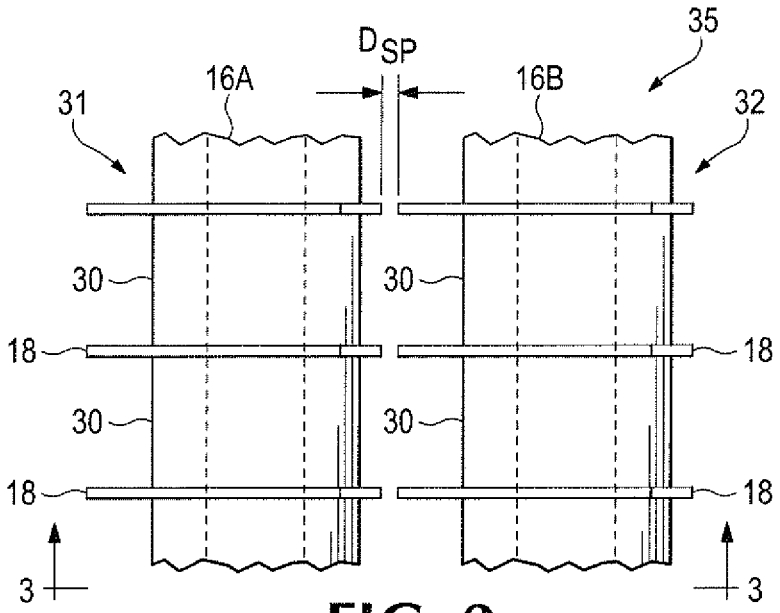
FIG. 2 illustrates a top plan view of a disc screen.

FIG. 2 illustrates a top plan view of a disc screen 35. The disc screen 35 may comprise a plurality of discs 18 mounted in a spaced-apart parallel orientation on a first shaft 16A. The plurality of discs 18 may be separated by one or more spacers 30, which are also mounted on the first shaft 16A. In one embodiment, the plurality of discs 18 may be separated by one or more smaller discs instead of and/or in addition to the one or more spacers 30. The plurality of discs 18 may be configured to rotate concurrently with each other about first shaft 16A. A first disc 31 may also be mounted to the first shaft 16A. First disc 31 may be mounted such that is spaced-apart from, and parallel to, one or more of the plurality of discs 18.

A plurality of discs, including a second disc 32, may be mounted in a spaced-apart parallel orientation on a second shaft 16B. As first shaft 16A and/or second shaft 16B rotate, the first disc 31 may be separated from the second disc 32 by a disc space Dsp. Each of the discs 18 on first shaft 16A may be separated from adjacent discs, located on second shaft 16B, by a disc space. In some embodiments, the distance associated with disc space Dsp remains constant as first disc 31 and/or second disc 32 are rotated about their respective shafts 16A, 16B.

The discs 18 may be mounted on first shaft 16A in a substantially coplanar row in substantially parallel relation and radiating outwardly at right angles to the longitudinal axes of first shaft 16A. The discs 18 can be held in place by the spacers 30. The discs 18 and/or spacers 30 may comprise central apertures to receive first shaft 16A therethrough. The spacers 30 may be of substantially uniform size and placed between the discs 18.

Depending on the character and size of the material to be sorted and/or classified, the discs 18 may range from a few inches to more than a foot in diameter. Again, depending on the size, character and quantity of the material, the number of discs per shaft range from several discs to several dozen discs.

Figure 3A:
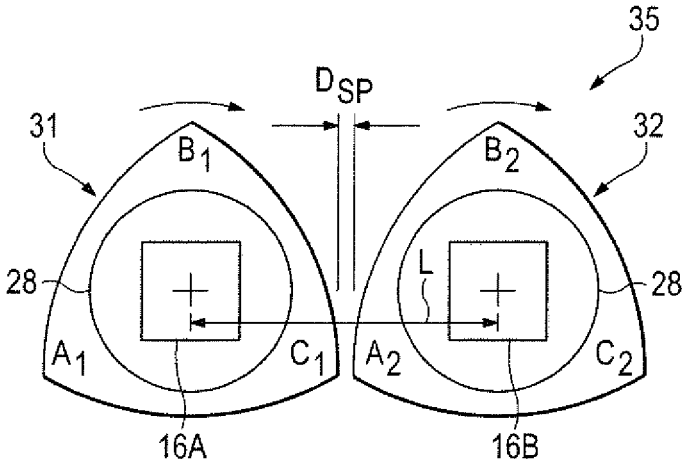
FIG. 3A illustrates a fragmentary vertical sectional detail view of the disc screen of FIG. 2 taken substantially along the line 3-3.

FIG. 3A illustrates a fragmentary vertical sectional detail view of the disc screen 35 of FIG. 2 taken substantially along the line 3-3. The first disc 31 is shown as including three vertices, A1, B1, and C1, each of which is separated by a curved side S. The second disc 32 is similarly shown as including three vertices, A2, B2, and C2. A first axis of rotation associated with first shaft 16A is located a distance L from a second axis of rotation associated with second shaft 16B.

A perimeter of the first disc 31 and/or the second disc 32 may be defined by three sides having substantially the same degree of curvature. For example, the perimeter of the first disc 31 may be defined by drawing an equilateral triangle which has vertices A1, B1, and C1, and thereafter drawing three arcs.

A first side may be defined by drawing a first arc between vertices B1 and C1 using vertex A1 as the center point of the first arc. A second side may be defined by drawing a second arc between vertices C1 and A1 using vertex B1 as the center point for the second arc. And a third side may be defined by drawing a third arc between vertices A1 and B1 using vertex C1 as the center point of the third arc. The disc space Dsp between first disc 31 and second disc 32 may be determined as the distance between vertex C1 of the first disc 31 and vertex A2 of the second disc 32.

In some embodiments, first disc 31 and/or second disc 32 may be mounted as disc assemblies or disc sets arranged concentrically and in an axially extending relation on the one or more hubs 28 complementary to and adapted for slidable concentric engagement with the perimeter of first shaft 16A and/or second shaft 16B. First disc 31 and/or second disc 32 may comprise central apertures to receive the hubs 28 therethrough. First disc 31 and/or second disc 32 may be attached in spaced relation to other discs axially along the hubs 28 in any suitable manner, as for example by welding or applying mounting bolts and/or brackets.

Figure 3B:
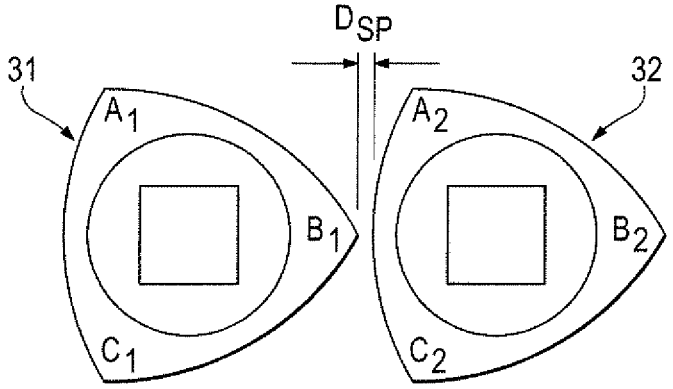
FIG. 3B illustrates the sectional detail view of FIG. 3, where the discs are rotated 90 degrees about their respective horizontal axes.

FIG. 3B illustrates the sectional detail view of FIG. 3, where first disc 31 and second disc 32 are rotated 90 degrees about their respective horizontal axes of rotation. The disc space Dsp between first disc 31 and second disc 32 may be determined as the approximate distance between vertex B1 of the first disc 31 and the side of the second disc 32 intermediate vertices A2 and C2. In some embodiments, the disc space Dsp shown in FIG. 3B represents a distance equal to the disc space Dsp shown in FIG. 3A.

Figure 3C:
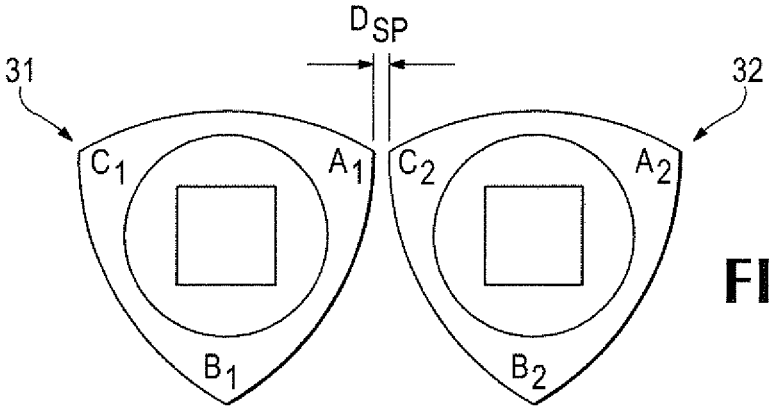
FIG. 3C illustrates the sectional detail view of FIG. 3, where the discs are rotated 180 degrees about their respective horizontal axes.

FIG. 3C illustrates the sectional detail view of FIG. 3, where the discs are rotated 180 degrees about their respective horizontal axes. The disc space Dsp between first disc 31 and second disc 32 may be determined as the approximate distance between vertex A1 of the first disc 31 and the vertex C2 the second disc 32. In some embodiments, the disc space Dsp shown in FIG. 3A represents a distance equal to the disc space Dsp shown in FIGS. 3A and/or 3B.

Figure 3D:
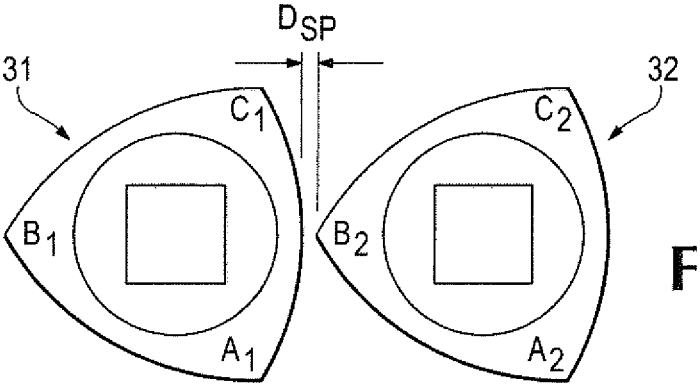
FIG. 3D illustrates the sectional detail view of FIG. 3, where the discs are rotated 270 degrees about their respective horizontal axes.

FIG. 3D illustrates the sectional detail view of FIG. 3, where the discs are rotated 270 degrees about their respective horizontal axes. The disc space Dsp between first disc 31 and second disc 32 may be determined as the approximate distance between the side of the first disc 31 intermediate vertices A1 and C1 and the vertex B2 of the second disc 32. In some embodiments, the disc space Dsp shown in FIG. 3A represents a distance equal to the disc space Dsp shown in FIGS. 3A, 3B, and/or 3C.

First disc 31 and/or second disc 32 may have a perimeter shaped so that disc space Dsp remains substantially constant during rotation of one or both discs 31, 32. The disc space Dsp may change location, or shift laterally towards either first shaft 16A or second shaft 16B, during the rotation of first disc 31 and/or second disc 32. As first disc 31 and/or second disc 32 rotate, they may move the material in an up and down fashion which creates a sifting effect and facilitates classification and/or sorting of the material.

Figure 4:
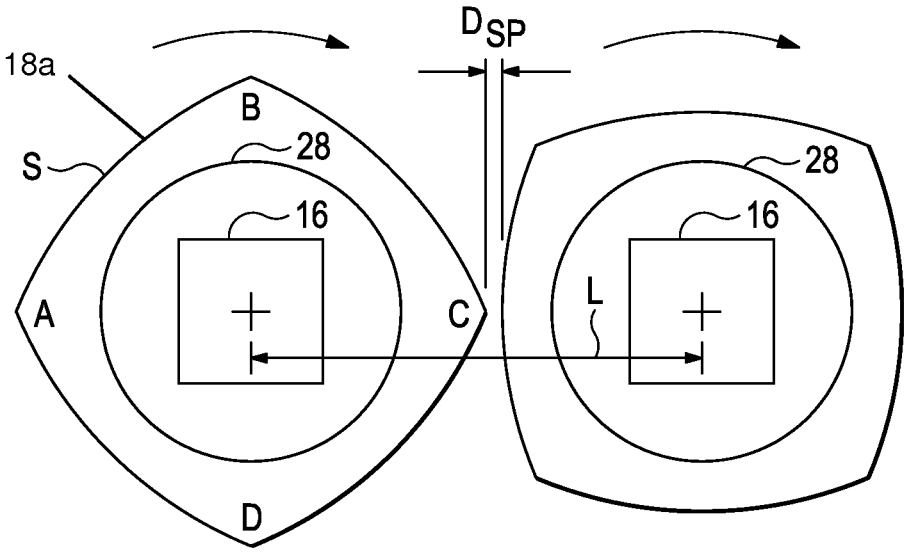
FIG. 4 illustrates a four-sided material separation disc.

FIG. 4 illustrates a four-sided material separation disc 18*a*. The perimeter of disc 18*a* may be defined by four sides having substantially the same degree of curvature. For example, the perimeter of disc 18*a* may be defined by:

1) determining the desired center distance L between adjacent shafts 2) determining the desired clearance or gap $D_{sp}$ between adjacent coplanar discs; and 3) drawing a square having corners A, B, C, and D and side length S.

The side length S may be calculated as follows:

$$S=(L-D_{sp})*\text{COS } 45/\text{COS } 22.5.$$

Where S is the length of side S of disc 18*a*, L is the distance between shafts and/or centers of rotation of two adjacent discs, and Dsp is the distance between the two adjacent discs.

Arcs may then be drawn between corners A and B, B and C, C and D, and D and A. The radii R of the arcs may be calculated as the difference between distance L and the disc space $D_{SP}$, or where $R=L-D_{SP}$.

Disc 18*a* may be used for classifying materials which are more fragile or delicate. As the number of sides of the discs are increased, from 3 to 4 or 5 (or more) for example, the amplitude of rotation decreases. While discs having fewer sides may enhance the sifting action of the screen, the associated higher amplitudes of the sifting action may be more likely to damage delicate or fragile materials.

A disc screen, or combination of disc screens, may be used to sort small, intermediate, and large sized materials, as discussed above. In the case of sorting small sized materials, in particular, the material may tend to adhere to itself (e.g., clump) and/or adhere to the discs, particularly in humid operating conditions, or where the material itself contains a sufficiently high level of liquid saturation or wet components. The adhesion may result in less efficient separation of the materials, with clumps of materials being improperly sorted as larger sized Overs and, in some cases, may obstruct and/or "jam" the discs.

Figure 5A:
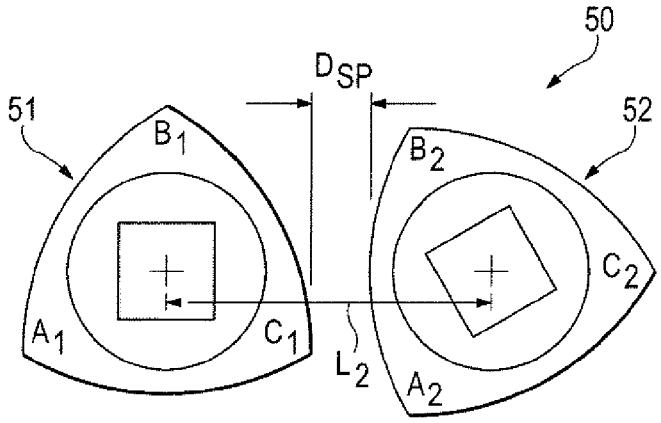
FIG. 5A illustrates a material separation screen configured with variable disc spacing.

FIG. 5A illustrates a material separation screen 50 configured with variable disc spacing Dsp. Material separation screen 50 may comprise two or more discs, similar to disc screen 35 of FIG. 2. The two or more discs may comprise a first disc 51 and a second disc 52. The centers of rotation of first and second discs 51, 52 may be separated by a distance L. Distance L may indicate the distance between parallel spaced-apart shafts upon which first disc 51 and second disc 52 are mounted on, respectively.

First disc 51 and second disc 52 are illustrated as having three sides, although discs having more sides may be used. First disc 51 may have three vertices, or corners, which connect the three sides. For example, first disc 51 may have a first vertex A1, a second vertex B1, and a third vertex C1. Similarly, second disc 52 may have a first vertex A2, a second vertex B2, and a third vertex C2.

As compared to FIG. 3A, first disc 51 may be located in a rotational position which is the same as first disc 31. Second disc 52, however, initially starts off at a thirty degree offset rotational position which, in this example, is shown in the counterclockwise direction of rotation. The disc space Dsp between first disc 51 and second disc 52 may be determined as the approximate distance between vertex C1 of the first disc 51 and the side of the second disc 52 intermediate vertices A2 and B2.

Figure 5B:
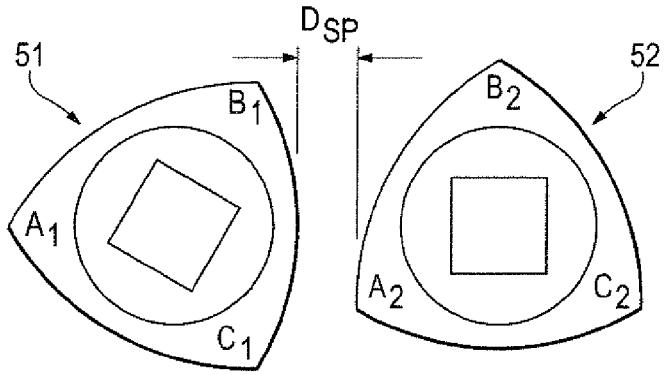
FIG. 5B illustrates the material separation screen of FIG. 5, where the two discs are rotated thirty degrees about their respective horizontal axes.

FIG. 5B illustrates the material separation screen of FIG. 5, where the two discs 51, 52 are rotated thirty degrees about their respective horizontal axes, as compared to FIG. 5A. The disc space Dsp between first disc 51 and second disc 52 may be determined as the approximate distance between the side of the first disc 51 intermediate vertices B1 and C1 and the side of the second disc 52 intermediate vertices A2 and B2. In comparing FIG. 5B with FIG. 5A it can be seen that the disc space Dsp illustrated in FIG. 5B is larger than the disc space Dsp illustrated in FIG. 5A.

Figure 5C:
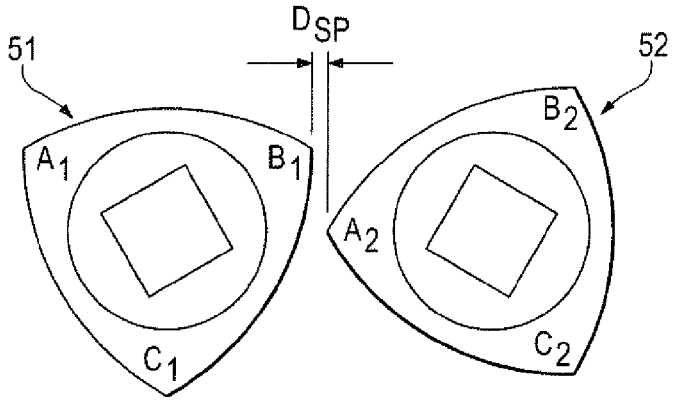
FIG. 5C illustrates the material separation screen of FIG. 5, where the two discs are rotated sixty degrees about their respective horizontal axes.

FIG. 5C illustrates the material separation screen of FIG. 5, where the two discs are rotated sixty degrees about their respective horizontal axes, as compared to FIG. 5A. The disc space Dsp between first disc 51 and second disc 52 may be determined as the approximate distance between vertex B1 of the first disc 51 and vertex A2 of the second disc 52. In comparing FIG. 5C with FIG. 5B it can be seen that the disc space Dsp illustrated in FIG. 5C is smaller than the disc space Dsp illustrated in FIG. 5B.

Figure 5D:
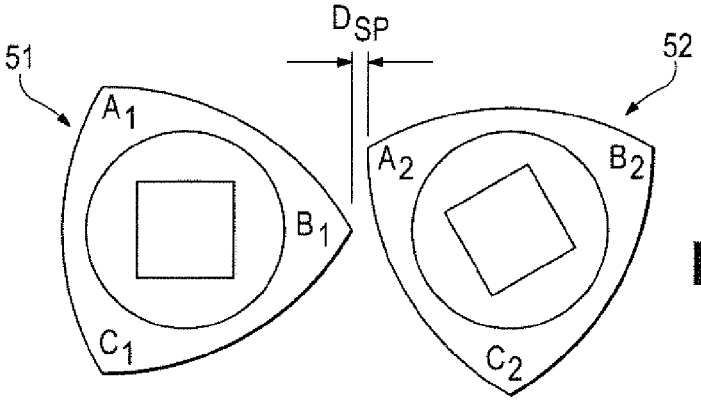
FIG. 5D illustrates the material separation screen of FIG. 5, where the two discs are rotated ninety degrees about their respective horizontal axes.

FIG. 5D illustrates the material separation screen of FIG. 5, where the two discs are rotated ninety degrees about their respective horizontal axes, as compared to FIG. 5A. The disc space Dsp between first disc 51 and second disc 52 may be determined as the approximate distance between vertex B1 of the first disc 51 and vertex A2 of the second disc 52. In comparing FIGS. 5A, 5B, 5C, and 5D, it can be seen that the disc space Dsp is configured to vary as one or both of the first disc 51 and the second disc 52 rotate. The variable disc space Dsp may continuously vary between a range of distances through one complete rotation of the discs 51, 52.

Figure 6:
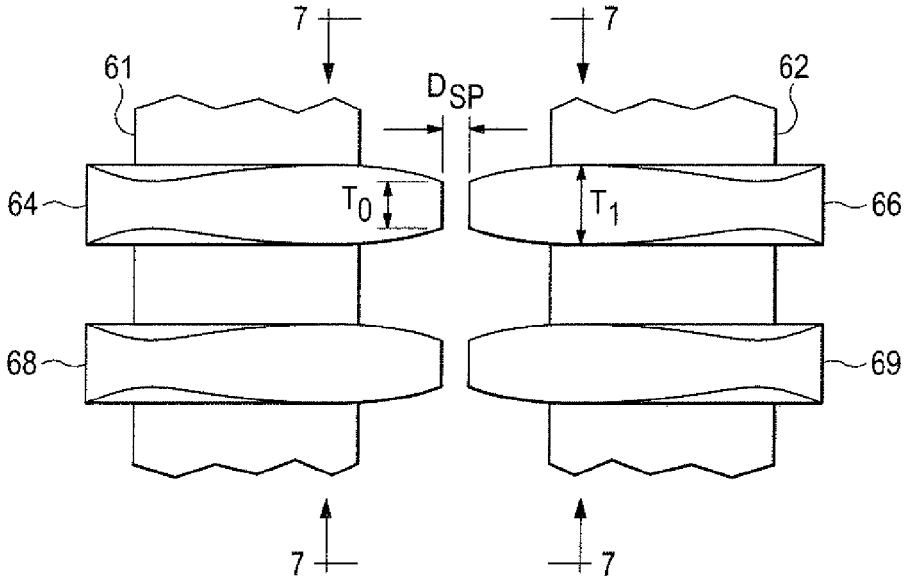
FIG. 6 illustrates a top plan view of another disc screen.

FIG. 6 illustrates a top plan view of another disc screen 60. The disc screen 60 may comprise two or more shafts, including first shaft 61 and second shaft 62. A plurality of discs may be mounted, or otherwise attached, to the first shaft 61. For example, a first disc 64 and a second disc 68 may be mounted to first shaft 61. Similarly, a third disc 66 and a fourth disc 69 may be mounted to second shaft 62.

One or more discs on first shaft 61 may be separated from one or more discs on second shaft 62 by disc space Dsp. For example, first disc 64 may be separated from an adjacent disc, such as third disc 66, by disc space Dsp. Second disc 68 may also be separated from fourth disc 69 by disc space Dsp.

First disc 61 is shown as including a curved profile, or varied disc width, from a first width T0, to a second width T1. The second width T1 may be greater than the first width T0. As first disc 64 rotates about first shaft 61, the width of the first disc 64 when measured from a position that is adjacent third disc 66 may continuously vary between first width T0 and second width T1. The proximate width of one or more of second disc 68, third disc 66, and/or fourth disc 69 may similarly vary when the discs are rotated past a fixed point and/or position.

Figure 6A:
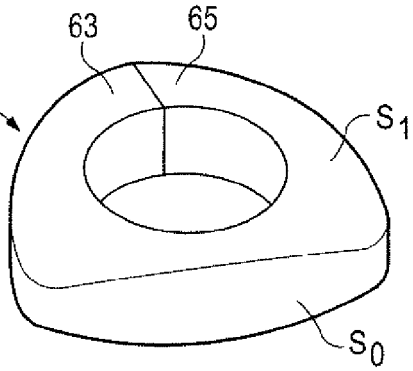
FIG. 6A illustrates a perspective view of a single disc.

FIG. 6A illustrates a perspective view of an example disc 67. A first side S1 of disc 67 may comprise a non-parallel surface. In some embodiment, first side S1 may appear to undulate or form a wave-like appearance about the perimeter of disc 67. The profile of the contact surface S0 of disc 67 illustrates the varying width of the disc about its perimeter.

Disc 67 may be illustrative of one or more of the discs 64, 66, 68, and/or 69 of FIG. 6. For purposes of illustration and explanation, disc 67 may be cut at one side. In this case, first disc has been arbitrarily cut at a location between a first end 63 and a second end 65.

Figure 6B:
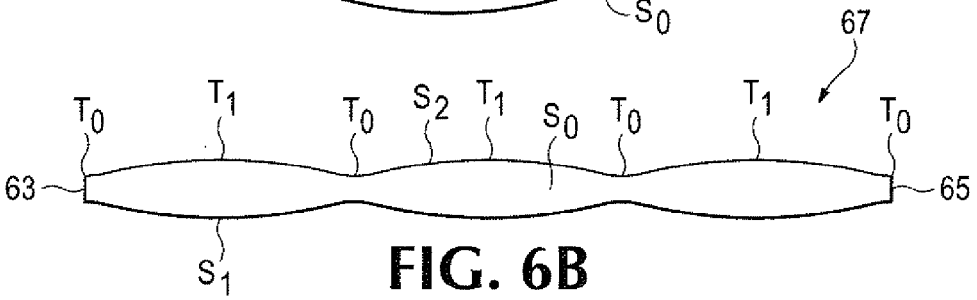
FIG. 6B illustrates a contour of the single disc of FIG. 6A.

FIG. 6B illustrates a contour of disc 67 after being cut, laid out, and conceptually flattened to show the change in disc width along the diameter of the disc 67. Disc 67 may comprise a first side S1 and a second side S2 located on an opposite side of disc 67 as the first side S1. A contact surface S0 may adjoin both first side S1 and second side S2.

A width of contact surface S0 may vary along a perimeter of disc 67. The width of contact surface S0 may continuously vary along the perimeter of the disc 67. Contact surface S0 may intersect first side S1 along an edge of disc 67. The edge may comprise a convex shape relative to a position located normal to the contact surface S0. In some embodiments, at least a portion of the width of contact surface S0 may vary according to a parabolic function. For example, contact surface S0 may vary from the narrowest width at width T0, to the greatest width at width T1, and then back to width T0. The variation in width of the disc 67 may be more or less than that shown in this and various other figures for purposes of illustration.

Additionally, or alternatively, the edge at which contact surface S0 intersects first side S1 may comprise a concave shape relative to a position located normal to the contact surface S0. At least a portion of the width of contact surface S0 may vary according to a hyperbolic function. For example, contact surface S0 may vary from the greatest width at width T1, to the narrowest width at width T0, and then back to width T1. The two edges of contact surface S0 may vary form alternating parabolic and hyperbolic outlines along the perimeter of disc 67. Contact surface S0 may vary continuously between width T0 and width T1 along the perimeter of disc 67.

At least one edge of contact surface S0 may vary between a convex shape and a concave shape, and in some embodiments, the at least one edge may continuously vary between the convex shape and the concave shape. The edge at which contact surface S0 intersects first side S1 and/or second side S2 may be sinusoidal in shape.

Figure 6C:
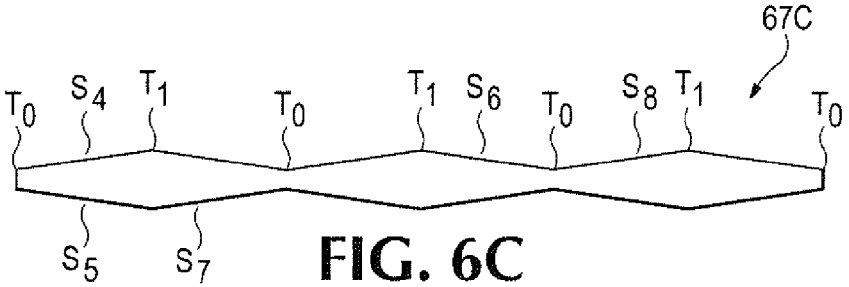
FIG. 6C illustrates a further example contour of a disc with variable disc width.

FIG. 6C illustrates a further example contour of a disc 67C with variable disc thickness, after being cut, laid out, and conceptually flattened as described with respect to FIG. 6B. The width of the contact surface of disc 67C may continuously vary along the perimeter of disc 67C. Disc 67C may comprise three sides S4, S6, and S8, forming a three-sided disc.

A first side S4 may comprise a first section S5 of disc 67C which may vary from the narrowest width at width T0, to the greatest width at width T1. Additionally, first side S4 may comprise a second section S7 which may vary from the greatest width T1, and to the narrowest width T0. The width of disc 67C may vary linearly between width T0 and width T1, and/or from width T1 to width T0. In some embodiments, each of the three sides S4, S6, and S8 may vary linearly between width T0 and width T1 and/or between width T1 and width T0.

Figure 7A:
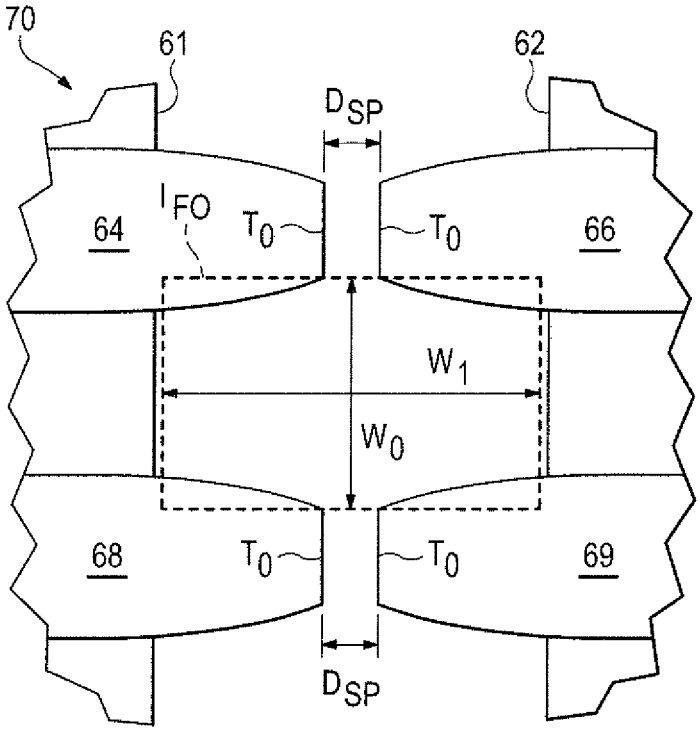
FIG. 7A illustrates a detailed partial view of the disc screen of FIG. 6, with the discs located in a first position of rotation.

FIG. 7A illustrates a detailed partial view of the disc screen of FIG. 6 taken substantially along the line 7-7, with discs located in a first position of rotation. In the first position of rotation, the widths of first disc 64, second disc 68, third disc 66, and fourth disc 69 are shown as having an approximate width T0 at the portion of the discs adjacent the interfacial opening (IFO). The IFO may be associated with a width W0 and length W1 defining an approximate rectangular cross-section. In three-dimensions, the IFO may form a substantially rectangular shaped box, having sides with width W0 and length W1, respectively.

Width W0 of the IIFO may extend between the side of first disc 64 and the side of second disc 68. Additionally, width W0 of the IFO may extend between the side of third disc 66 and the side of fourth disc 69. Length W1 of the IFO may be formed between adjacent shafts, such as first shaft 61 and second shaft 62. In some embodiments, length W1 of the IFO may extend between spacers or secondary discs mounted on first shaft 61 and/or second shaft 62. The spacers and/or secondary discs may be mounted intermediate first disc 64 and second disc 68 and/or between third disc 66 and fourth disc 69, respectively.

A disc space Dsp may exist between discs mounted on shafts 61 and 62. First shaft 61 and second shaft 62 may rotate in the same direction. In some examples, first shaft 61 and second shaft 62 may rotate at the same rotational speed.

Figure 7B:
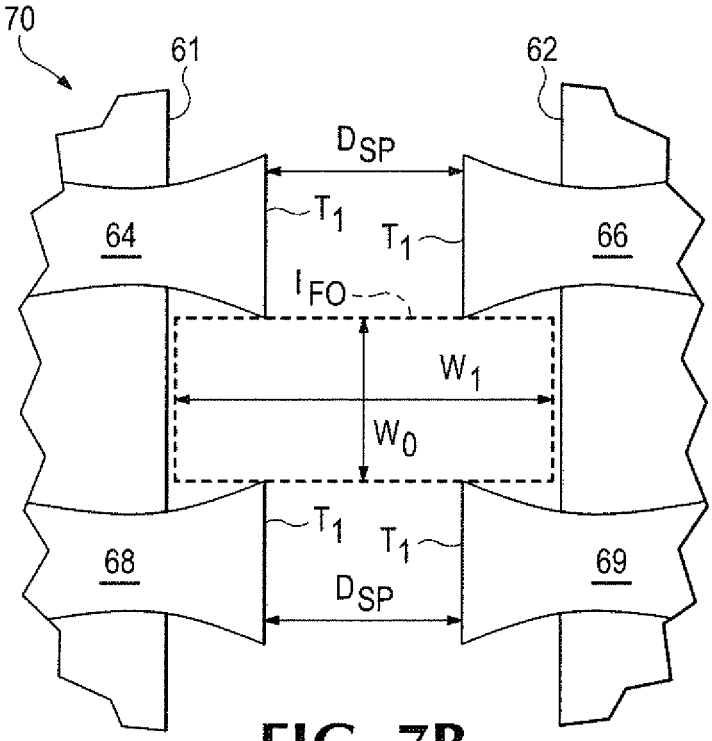
FIG. 7B illustrates a detailed partial view of the disc screen of FIG. 6, with the discs located in a second position of rotation.

FIG. 7B illustrates a detailed partial view of the disc screen of FIG. 6, with the discs located in a second position of rotation. In the second position of rotation, the widths of first disc 64, second disc 68, third disc 66, and fourth disc 69 are shown as having an approximate width T1 at the portion of the discs adjacent the IFO.

As width T1 is greater than width T0, the width W0 of the IFO as illustrated in FIG. 7B may be smaller than the width W0 of the IFO as illustrated in FIG. 7A. The width W0 of the IFO, as measured between first disc 64 and second disc 68, may vary according to a rotational position of the one or more discs about first shaft 61.

The disc space Dsp between first disc 64 and third disc 66 may equal the disc space Dsp between second disc 68 and fourth disc 69. In some embodiments, disc space Dsp remains uniform, constant, and/or does not change as the discs and shafts rotate.

Figure 7C:
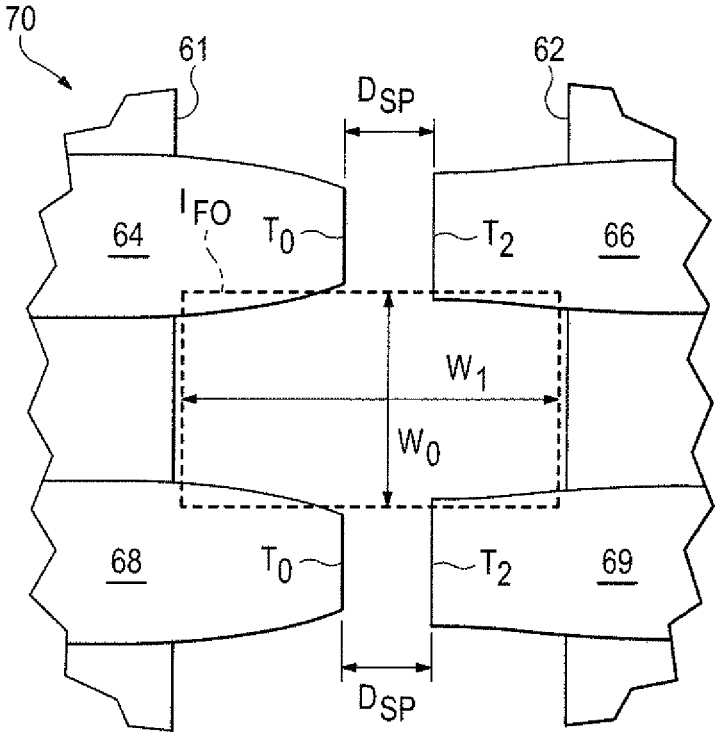
FIG. 7C illustrates a detailed partial view of the disc screen of FIG. 6 with one or more discs rotationally offset.

FIG. 7C illustrates a detailed partial view of the disc screen of FIG. 6 with one or more discs rotationally offset. Third disc 66 and/or fourth disc 69 may be rotationally offset from first disc 64 and/or second disc 68. For example, with reference to FIGS. 5A-5D, discs 66, 69 may be rotationally offset from discs 64, 68 by thirty degrees.

The widths of first disc 64 and second disc 68 are shown as having an approximate width T0 at the portion of the discs adjacent the IFO. The widths of third disc 66 and fourth disc 69 are shown as having an approximate width T2 at the portion of the discs adjacent the IFO. Width T2 may be understood as being a width which is greater than width T0 and less than width T1. In some examples, width T2 is intermediate width T0 and width T1.

Again with reference to FIGS. 5A-5D, it may be seen that the disc space Dsp may vary as a function of the rotational position of the shafts 61, 62 and/or discs 64, 68, 66, 69. Accordingly, the disc space Dsp illustrated in FIG. 7C may be understood to be less than the disc space Dsp as illustrated in FIG. 7B.

Second shaft 62 (and the associated discs 66, 69) may be rotationally offset from first shaft 61 (and its associated discs 64, 48) by a fixed amount of rotation. In some embodiments, first shaft 61 may rotate at a different speed than second shaft 62. Third disc 66 and fourth disc 69 may become rotationally offset from first disc 64 and second disc 68 due to the difference in rotational speed. The amount of rotational offset may vary with time.

First shaft 61 and/or second shaft 62 may comprise one or more spacers and/or discs located intermediate discs 64 and 68, and discs 66 and 69 respectively. The one or more spacers and/or discs may similarly be rotationally offset in order to vary length W1 of the IFO as one or both of first shaft 61 and second shaft 62 rotate.

The size of the IFO can be adjusted by employing spacers of various lengths and widths corresponding to the desired sized opening without replacing the shafts or having to manufacture new discs. The distance between adjacent discs can be changed by employing spacers of different lengths. Similarly, the distance between adjacent shafts (e.g., the length of the IFO) can be changed by employing spacers of different radial widths. The location of the shafts can be adjusted to also vary the size of the IFOs.

Figure 7D:
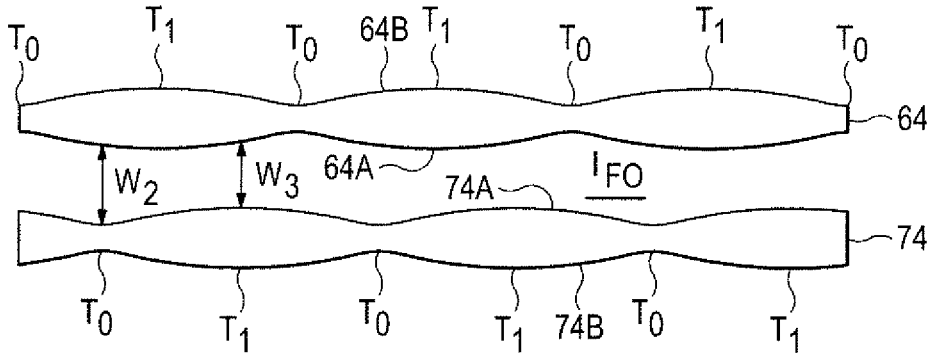
FIG. 7D illustrates a variable IFO between two adjacent discs.

FIG. 7D illustrates a variable IFO between two adjacent discs 64, 74, after being cut, laid out, and conceptually flattened as described with respect to FIG. 6B. One or both of the discs 64, 74 may be configured with variable width, for example, that varies between width T0 and width T1. The second disc 74 may be rotationally offset from the first disc 64. For purposes of illustration, second disc 74 is shown as being rotationally offset from first disc 64 by thirty degrees; however, different degrees of rotational offset may be similarly configured.

First disc 64 may comprise a first side 64A adjacent the IFO, and a second side 64B located on an opposite side of first disc 64 as the first side 64A. A distance between first side 64A and second side 64B may vary between width T0 and width T1 according to a rotational position of first disc 64 about its axis of rotation and/or about a shaft. Similarly, second disc 74 may comprise a first side 74A adjacent the IFO, and a second side 74B located on an opposite side of second disc 74 as the first side 74A. A distance between first side 74A and second side 74B may vary between width T0 and width T1 according to a rotational position of second disc 74 about its axis of rotation and/or about a shaft.

The width of the IFO may vary as a function of the widths of the first disc 64 and/or second disc 74. For example, a width W2 of the IFO at width T0 of second disc 74 is shown as being greater than width W3 of the IFO at width T1 of second disc 74. First disc 64 may comprise a contact surface having a width corresponding to the distance between first side 64A and second side 64B. The width of the contact surface may vary according to the rotational position of first disc 64 about the shaft. The width of the IFO may vary as a function of both the width of the first disc 64 and the width of the second disc 74.

A portion of first side 64A and/or second side 64B of first disc 64 may comprise a convex surface. In some embodiments, a portion of the width of the contact surface adjoining first side 64A and second side 64B of first disc 64 may vary according to a parabolic function. Additionally, a portion of first side 64A and/or second side 64B of first disc 64 may comprise a concave surface. In some embodiments, a width of the contact surface adjoining first side 64A and second side 64B may vary according to a hyperbolic function.

Figure 7E:
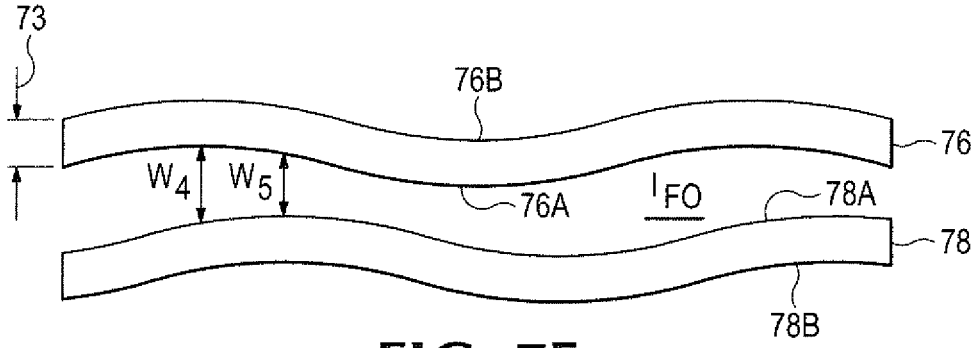
FIG. 7E illustrates a further example of a variable IFO between two adjacent discs.

FIG. 7E illustrates an example of a variable IFO between two adjacent discs 76, 78, after being cut, laid out, and conceptually flattened as described with respect to FIG. 6B. The second disc 78 may be rotationally offset from the first disc 76. For purposes of illustration, second disc 78 is shown as being rotationally offset from first disc 76 by thirty degrees; however, different degrees of rotational offset may be similarly configured.

The first disc 76 may comprise a first side 76A and a second side 76B. Similarly, the second disc 78 may comprise a first side 78A and a second side 78B. An IFO may extend between first side 76A of first disc 76 and first side 78A of second disc 78. First disc 76 is illustrated as having a width 73 with a uniform thickness around its perimeter. In some embodiments, second disc 78 may also have a width of uniform thickness.

One or more of sides 76A, 76B, 78A, and/or 78B may vary between a convex shape and a concave shape, and in some embodiments, may continuously vary between the convex shape and the concave shape. The one or more of sides 76A, 76B, 78A, and/or 78B may be sinusoidal in shape.

The IFO may vary in width according to a rotation of one or both of first disc 76 and second disc 78, according to a change in proximate distance between first side 76A of first disc 76 and first side 78A of second disc 78. For example, a first width W4 measured at a first position of rotation is illustrated as being greater than a second width W5 measured at a second position of rotation.

Figure 7F:
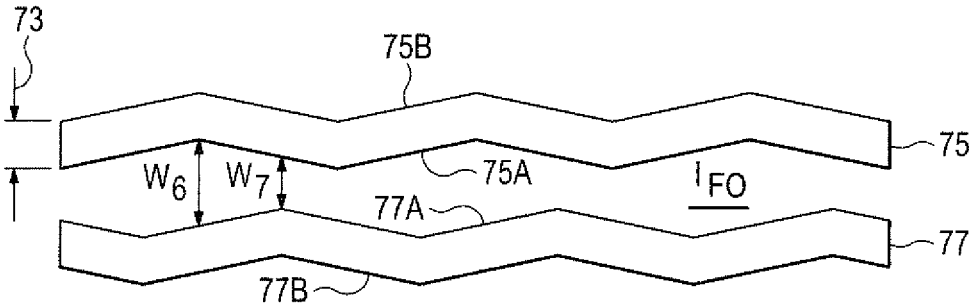
FIG. 7F illustrates yet a further example of a variable IFO between adjacent discs.

FIG. 7F illustrates a further example of a variable IFO between adjacent discs 75, 77, after being cut, laid out, and conceptually flattened as described with respect to FIG. 6B. The second disc 77 may be rotationally offset from the first disc 75. For purposes of illustration, second disc 77 is shown as being rotationally offset from first disc 75 by thirty degrees; however, different degrees of rotational offset may be similarly configured.

The first disc 75 may comprise a first side 75A and a second side 75B. Similarly, the second disc 77 may comprise a first side 78A and a second side 77B. An IFO may extend between first side 75A of first disc 75 and first side 77A of second disc 77. First disc 75 is illustrated as having a width 73 of approximately uniform thickness around its perimeter. In some embodiments, second disc 77 may also have a width of uniform thickness.

One or more of sides 75A, 75B, 77A, and/or 77B may comprise a plurality of angled and/or beveled shapes, forming a series of linear connected segments that form the perimeter of first disc 75 and/or second disc 77, respectively.

The IFO may vary in width according to a rotation of one or both of first disc 75 and second disc 77, according to a change in proximate distance between first side 75A of first disc 75 and first side 77A of second disc 77. For example, a first width W6 measured at a first position of rotation is illustrated as being greater than a second width W7 measured at a second position of rotation.

Figure 8:
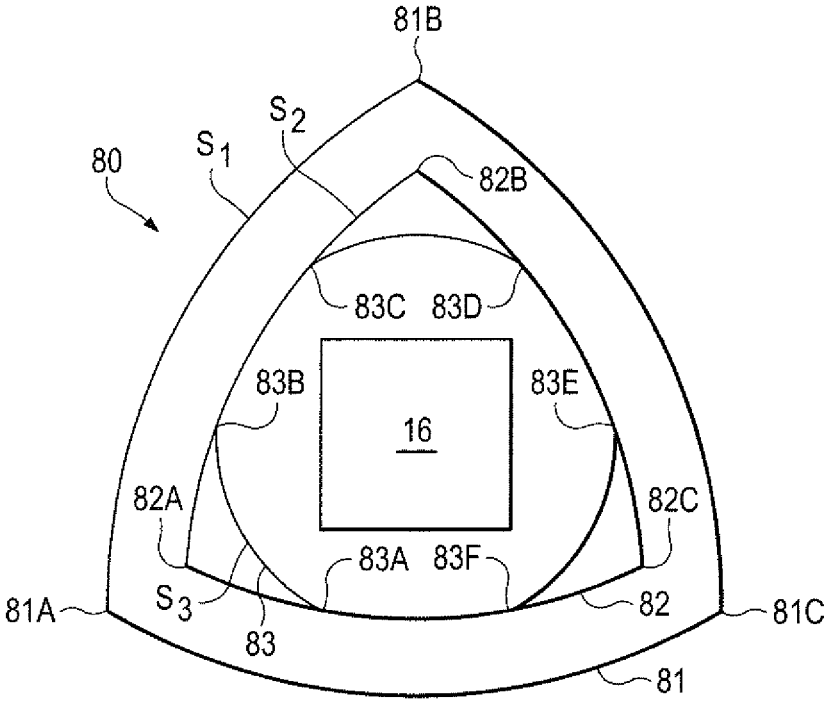
FIG. 8 illustrates a composite disc assembly.

FIG. 8 illustrates a composite disc assembly 80, comprising a primary disc 81 and a secondary disc 82. Primary disc 81 is illustrated as having three arched sides that form an outside perimeter. For example, one side S1 may be formed between vertex 81A and vertex 81B of primary disc 81. Primary disc 81 may comprise three vertices, including first vertex 81A, second vertex 81B, and third vertex 81C.

Secondary disc 82 may be located adjacent primary disc 81 and share a common axis of rotation. Secondary disc 82 may also have three arched sides S2 that form an outside perimeter substantially the same shape as primary disc 81, but with a smaller footprint. For example, the outside perimeter of secondary disc 82 may be smaller than the outside perimeter of primary disc 81. One side S2 of secondary disc may be formed between vertex 82A and vertex 82B of secondary disc 82. Secondary disc 82 may comprise three vertices, including first vertex 82A, second vertex 82B, and third vertex 82C.

Composite disc assembly 80 may be made from a unitary piece of rubber, polymer, nylon, plastic, steel, metal, other materials of varying hardness and/or softness, or any combination thereof. A softer material, such as rubber, may provide more friction force, whereas a harder material, such as steel, may have improved durability. In some embodiments, primary disc 81 may be formed from a separate piece and/or pieces of material as secondary disc 82. Primary disc 81 may comprise a first material and/or first combination of materials, and secondary disc 82 may comprise a second material and/or second combination of materials. The second material may be harder than the first material. In other embodiments, the first material may be harder than the second material.

Composite disc assembly 80 may comprise a spacer 83. The spacer 83 together with primary disc 81 and secondary disc 82 may be mounted on a shaft 16. Spacer 83 may comprise a plurality of sides, such as side S3. In some embodiments, spacer 83 may comprise six sides formed between a plurality of vertices, such as vertices 83A, 83B, 83C, 83D, 83E, and 83F, although more or fewer numbers of sides and/or vertices are contemplated herein.

In some embodiments, spacer 83 may comprise a third disc, having a plurality of arched sides. Spacer 83 may be associated with a smaller perimeter than secondary disc 82. Spacer 83 may be formed from the same material as primary disc 81 and/or secondary disc 82. Additionally, spacer 83 may be formed from a single unitary piece of material as primary disc 81 and/or secondary disc 82, or from a separate piece and/or pieces of material.

Figure 9:
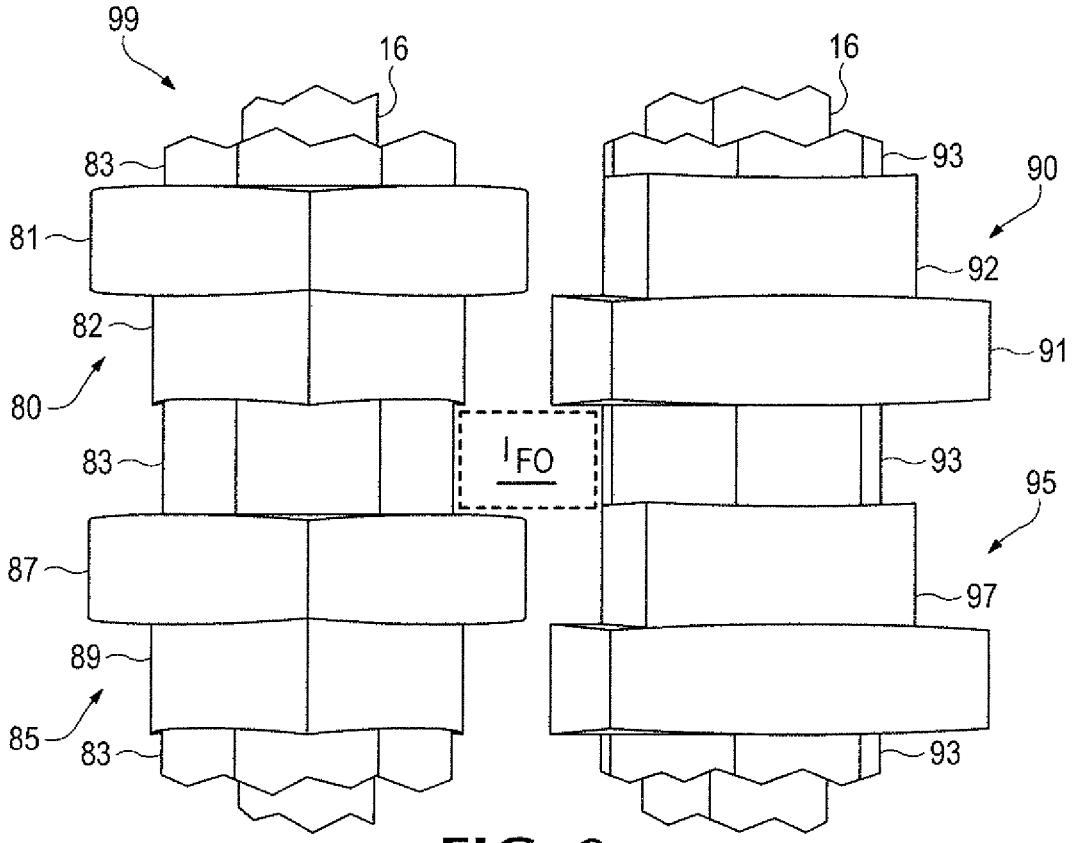
FIG. 9 illustrates a disc screen comprising a plurality of composite disc assemblies.

FIG. 9 illustrates a disc screen 90 comprising a plurality of composite disc assemblies 80, 85, 90, 95. The first disc assembly 80 and the second disc assembly 85 may be mounted on the same shaft. Similarly, the third disc assembly 90 and the fourth disc assembly 95 may be mounted on a spaced apart parallel shaft.

An IFO may extend laterally between secondary disc 82 of first disc assembly 80 and a primary disc 87 of the second disc assembly 85. Additionally, the IFO may extend laterally between a primary disc 91 of third disc assembly 90 and a secondary disc 97 of the fourth disc assembly 95. The IFO may extend longitudinally between spacer 83 of first disc assembly 80 and a spacer 93 of fourth disc assembly 95.

Primary disc 81 of first disc assembly 80 may be mounted in lateral alignment with a secondary disc 92 of third disc assembly 90. Additionally, secondary disc 82 may be mounted in lateral alignment with primary disc 91 of third disc assembly 90.

In some embodiments, primary discs 81, 87 may maintain a substantially constant spacing (e.g., disc space) with secondary discs 92, 97, respectively, during rotation. The primary discs 81, 87 may be alternating aligned with the secondary discs 82, 89 laterally across each shaft. Similarly, primary discs 81, 87 may be longitudinally aligned with secondary discs 92, 97 on the adjacent shaft.

Composite disc assemblies 80, 85, 90, 95 may comprise one or more discs and/or spacers having a triangular profile with three arched sides. However, the discs can have any number of arched sides, such as the example shown by the four sided disc in FIG. 4.

The different sizes and alignment of the discs on the adjacent shafts may create a stair-step shaped spacing laterally between the discs on the two shafts. Different spacing between the primary discs and secondary discs, as well as the size and shapes of the primary and secondary discs can be varied according to the types of materials being separated.

Figure 9A:
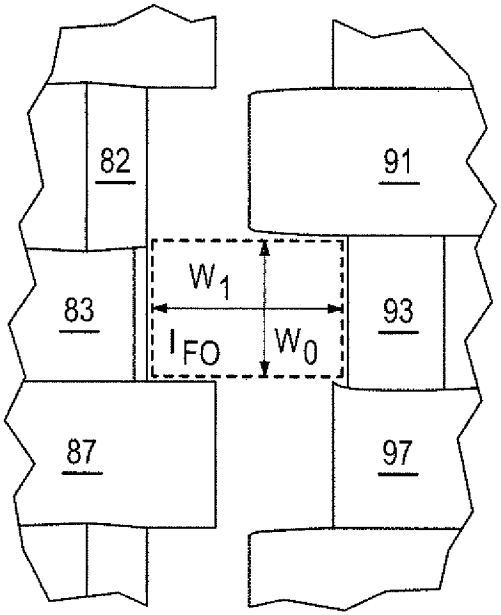
FIG. 9A illustrates an enlarged partial view of the composite disc assemblies of FIG. 9 rotated to a first position.

FIG. 9A illustrates an enlarged partial view of the IFO of FIG. 9 with the composite disc assemblies 80, 85, 90, 95 rotated to a first position. The lateral width W0 of the IFO may be formed between primary disc 87 and secondary disc 82. Additionally, the lateral width W0 may be formed between primary disc 91 and secondary disc 97. The longitudinal length W1 of the IFO may be formed between spacer 83, located on a first shaft, and spacer 93, located on a second shaft.

Figure 9B:
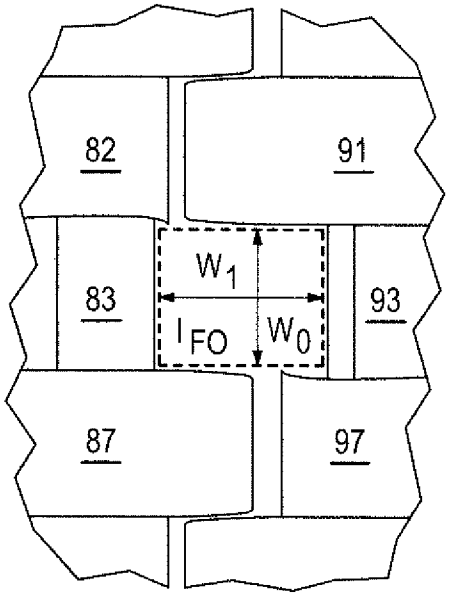
FIG. 9B illustrates an enlarged partial view of the composite disc assemblies of FIG. 9 rotated to a second position.

FIG. 9B illustrates an enlarged partial view of the IFO of FIG. 9 with the composite disc assemblies 80, 85, 90, 95 rotated to a second position. At the second position, the lateral width W0 may become smaller than the lateral width W0 illustrated in FIG. 9A. As the lateral width W0 decreases, the longitudinal length W1 of the IFO may increase as compared with the longitudinal length W1 illustrated in FIG. 9A.

Spacer 93 may be rotationally offset from spacer 83. Rotationally offsetting one or more of the spacers 83, 93 may cause the longitudinal length W1 of the IFO to vary during rotation. Accordingly, both the lateral and longitudinal dimensions of the IFO may be made to vary through a rotation of one or more of the disc assemblies 80, 85, 90, 95. The lateral width W0 and the longitudinal length W1 may vary at the same time, or concurrently with each other.

In some embodiments, primary disc 91 may be rotationally offset from secondary disc 82. Similarly, primary disc 87 may be rotationally offset from secondary disc 97. Rotationally offsetting one or more discs may cause the disc spacing between adjacent discs to vary during rotation.

Figure 9C:
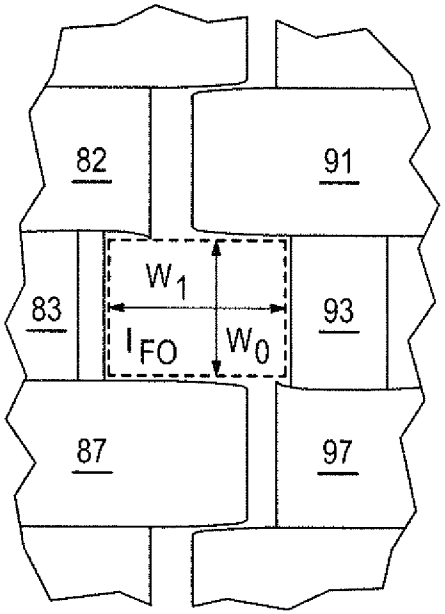
FIG. 9C illustrates an enlarged partial view of the composite disc assemblies of FIG. 9 rotated to a composite disc assemblies of FIG. 9A rotated to a third position.

FIG. 9C illustrates an enlarged partial view of the IFO of FIG. 9 with the composite disc assemblies 80, 85, 90, 95 rotated to a third position. At the third position, the lateral width W0 may become larger than the lateral width W0 illustrated in FIG. 9A and/or FIG. 9B. As the lateral width W0 increases, the longitudinal length W1 of the IFO may decrease as compared with the longitudinal length W1 illustrated in FIG. 9A and/or FIG. 9B.

It will be understood that variations and modifications may be effected without departing from the spirit and scope of the novel concepts of this invention.

The invention claimed is:

1. A disc for a material separation screen, comprising:
a first side;
a second side located on an opposite side of the disc as the first side; and
a contact surface adjoining the first side of the disc at a first edge of the contact surface and adjoining the second side of the disc at a second edge of the contact surface, wherein a width of the contact surface varies along a perimeter of the disc, and wherein the first edge of the contact surface varies between a convex shape and a concave shape along the perimeter of the disc.

2. The disc of claim 1, wherein the width of the contact surface continuously varies along the perimeter of the disc.

3. The disc of claim 1, wherein the width of the contact surface varies according to a sinusoidal function associated with the first edge of the contact surface.

4. The disc of claim 3, wherein the width of the contact surface further varies according to a sinusoidal function associated with the second edge of the contact surface.

5. The disc of claim 1, wherein the variation between the convex shape and the concave shape of the first edge of the contact surface is sinusoidal in shape.

6. The disc of claim 5, wherein the second edge of the contact surface is sinusoidal in shape, and wherein the width of the contact surface varies as a function of both the sinusoidal shape of the first edge of the contact surface and the sinusoidal shape of the second edge of the contact surface.

7. The disc of claim 1, wherein the first edge of the contact surface continuously varies between the convex shape and the concave shape around an entirety of the perimeter of the disc.

8. The disc of claim 7, wherein the width of the contact surface varies between a minimum width and a maximum width, wherein the minimum width of the contact surface is located adjacent the concave shape associated with the first edge, and wherein the maximum width of the contact surface is located adjacent the convex shape associated with the first edge.

9. The disc of claim 1, wherein both the first edge of the contact surface and the second edge of the contact surface continuously vary between the convex shape and the concave shape.

10. The disc of claim 1, wherein the first edge of the contact surface and the second edge of the contact surface form alternating parabolic and hyperbolic outlines along the perimeter of the disc.

11. A disc screen, comprising:
a shaft;
a first disc mounted on the shaft, wherein the first disc comprises:
a first side;
a second side located on an opposite side of the first disc as the first side; and a contact surface comprising a perimeter of the first disc, wherein the contact surface adjoins the first side at a first edge of the contact surface and adjoins the second side at a second edge of the contact surface, wherein a width of the contact surface varies along the perimeter of the first disc, and wherein the first edge of the contact surface varies between a convex shape and a concave shape along the perimeter of the first disc; and a second disc mounted on the shaft, wherein an interfacial opening (IFO) extends between the first disc and the second disc, and wherein a width of the IFO as measured between the first disc and the second disc varies according to a rotational position of the shaft.

12. The disc screen of claim 11, wherein the width of the IFO varies as a function of the distance between the first side and the second side of the first disc.

13. The disc screen of claim 11, wherein a width of the second disc varies according to a rotational position of the second disc about the shaft.

14. The disc screen of claim 13, wherein the width of the IFO varies as a function of both a width of the first disc and the width of the second disc.

15. The disc screen of claim 11, wherein the width of the contact surface varies according to a sinusoidal function.

16. The disc screen of claim 11, wherein the width of the contact surface varies according to a hyperbolic function.

17. The disc screen of claim 11, wherein the second disc comprises:

a third side;

a fourth side located on an opposite side of the second disc as the third side; and a second contact surface comprising a perimeter of the second disc, wherein the second contact surface adjoins the third side at a third edge of the second contact surface and adjoins the fourth side at a fourth edge of the second contact surface, wherein a width of the second contact surface varies along the perimeter of the second disc, and wherein the third edge of the contact surface varies between a convex shape and a concave shape along the perimeter of the second disc.

18. The disc screen of claim 17, wherein the second disc is rotationally offset from the first disc, and wherein the width of the IFO varies in response to the rotational offset.

19. The disc screen of claim 17, wherein the perimeter of the first disc is greater than a perimeter of the second disc.

20. The disc screen of claim 18, further comprising:

a spacer intermediate the first disc and the second disc, wherein a perimeter of the spacer is smaller than the perimeter of the second disc.

21. The disc screen of claim 11, further comprising:

a second shaft, wherein the second shaft is parallel to the shaft;

a first spacer mounted on the shaft intermediate the first disc and the second disc; and a second spacer mounted on the second shaft, wherein the second spacer is mounted adjacent to the first spacer, wherein a length of the IFO extends longitudinally between the first spacer and the second spacer, wherein the second spacer is rotationally offset from the first spacer, and wherein the length of the IFO varies in response to the rotational offset.

22. The disc screen of claim 21, wherein the width of the IFO varies in response to the variation of the width of the contact surface of the first disc.

23. The disc screen of claim 22, wherein both the width of the IFO and the length of the IFO vary concurrently.

24. The disc screen of claim 23, wherein the width of the IFO decreases as the length of the IFO increases.

* * * * *